US011051094B2

(12) United States Patent
Schultz

(10) Patent No.: US 11,051,094 B2
(45) Date of Patent: Jun. 29, 2021

(54) INTERCHANGEABLE PORT ACOUSTICAL CAP FOR MICROPHONES

(71) Applicant: Shure Acquisition Holdings, Inc., Niles, IL (US)

(72) Inventor: Jordan Schultz, Chicago, IL (US)

(73) Assignee: Shore Acquisition Holdings, Inc., Niles, IL (US)

( * ) Notice: Subject to any disclaimer, the term of this patent is extended or adjusted under 35 U.S.C. 154(b) by 26 days.

(21) Appl. No.: 16/663,911

(22) Filed: Oct. 25, 2019

(65) Prior Publication Data

US 2021/0127191 A1 Apr. 29, 2021

(51) Int. Cl.

| | |
|---|---|
| ***H04R 1/04*** | (2006.01) |
| ***H04R 3/00*** | (2006.01) |
| ***H04R 1/08*** | (2006.01) |
| ***H04R 1/28*** | (2006.01) |

(52) U.S. Cl.

CPC ..... *H04R 1/083* (2013.01); *H04R 1/04* (2013.01); *H04R 1/2807* (2013.01); *H04R 3/00* (2013.01); *H04R 2420/07* (2013.01)

(58) Field of Classification Search

CPC ..... H04R 1/083; H04R 1/04; H04R 1/2807; H04R 3/00; H04R 2420/07

USPC ..... 381/92, 111, 122, 176, 337, 345, 353, 381/360, 361; 181/198, 242

See application file for complete search history.

(56) References Cited

U.S. PATENT DOCUMENTS

| | | | | |
|---|---|---|---|---|
| 3,651,286 | A | 3/1972 | Gorike et al. | |
| 4,363,937 | A | 12/1982 | Bruna | |
| 5,268,965 | A | 12/1993 | Badie et al. | |
| 5,455,869 | A | 10/1995 | Miscavige | |
| 9,351,062 | B2 | 5/2016 | Inoda et al. | |
| 9,736,605 | B2 | 8/2017 | Yoo | |
| 2006/0093167 | A1 | 5/2006 | Mogelin et al. | |
| 2007/0036385 | A1 | 2/2007 | Harvey et al. | |
| 2007/0253570 | A1* | 11/2007 | Fukumoto | H04R 1/083 381/71.12 |
| 2012/0328142 | A1* | 12/2012 | Horibe | H04R 1/406 381/355 |
| 2013/0070951 | A1 | 3/2013 | Tanaka et al. | |

(Continued)

FOREIGN PATENT DOCUMENTS

| | | | |
|---|---|---|---|
| CN | 106028196 | A | 10/2016 |
| CN | 107864416 | A | 3/2018 |

(Continued)

OTHER PUBLICATIONS

Jan. 22, 2021—(WO) International Search Report and Written Opinion—App PCT/US2020/055801.

*Primary Examiner* — Vivian C Chin

*Assistant Examiner* — Friedrich Fahnert

(74) *Attorney, Agent, or Firm* — Banner & Witcoff, Ltd.

(57) ABSTRACT

An acoustical cap that covers a microphone and allows a user to adjust the frequency response of the sound that the microphone receives. The acoustical cap has at least two different inlets that connect to respective cavities. These inlets and their associated cavities form resonators that have different frequency responses. Because the microphone cap has multiple resonators, a user is able to quickly and easily adjust the frequency response of the sound that the microphone receives by adjusting the orientation of the acoustical cap instead of having to carry multiple acoustical caps.

18 Claims, 9 Drawing Sheets

(56) References Cited

U.S. PATENT DOCUMENTS

| | | | | |
|---|---|---|---|---|
| 2013/0129133 | A1* | 5/2013 | Inoda | H04R 1/08 381/337 |
| 2014/0233756 | A1 | 8/2014 | Inoda | |
| 2016/0150319 | A1* | 5/2016 | Yoo | H04R 19/04 381/92 |
| 2018/0048966 | A1 | 2/2018 | Segota et al. | |

FOREIGN PATENT DOCUMENTS

| | | | |
|---|---|---|---|
| DE | 4008713 | A1 | 9/1991 |
| EP | 1233643 | A2 | 8/2002 |
| GB | 1258464 | A | 12/1971 |

* cited by examiner

INTERCHANGEABLE PORT ACOUSTICAL CAP FOR MICROPHONES

FIELD

The present disclosure relates generally to microphones, and more particularly to small microphones that may be configured as, for example, lavalier, lapel, clip, body, earset, headset, collar, or neck microphones. These types of microphones can be worn by or attached to a person or instrument.

BACKGROUND

Microphones convert sound into an electrical signal through the use of a transducer that includes a diaphragm to convert sound into mechanical motion, which in turn is converted to an electrical signal. Generally, microphones can be categorized by their transducer method (e.g., condenser, dynamic, ribbon, carbon, laser, or microelectromechanical systems (MEMS)).

One use of a microphone is amplifying a single person or specific instrument, such as in the context of television, theater, public speaking, telemarketing, or a musical performance. In these instances, a user may either hold the microphone or use a microphone stand. An alternative, however, is to attach the microphone to a piece of clothing or the body. Microphones made for this purpose include lavalier, lapel, clip, body, headset, earset, collar, or neck microphones. These microphones may be more mobile and may allow one to use their hands without also having to use a microphone stand.

These type of microphones (e.g., lavalier microphones) can also be used with acoustical caps that cover the microphone. These acoustical caps may include holes that allow sound to enter into a resonant cavity that boosts or attenuates certain frequencies and thus changes the frequency response of the sound that the microphone receives. Which frequencies are emphasized and attenuated by the acoustical cap depend on size and shape of the hole(s) or inlet(s) of the acoustical cap as well as the size and shape of the cavity defined by the acoustical cap. This use of the size and shape of a cavity and its inlet(s) to emphasize certain acoustic frequencies is an example of taking advantage of what is commonly known as Helmholtz resonance. In order to change the frequency response of the sound the microphone receives based on recording in different environments, users will alternate between caps that have different sizes of inlets and create different sizes of resonate cavities.

BRIEF SUMMARY

The following presents a simplified summary of the disclosure in order to provide a basic understanding of some aspects of the disclosure. This summary is not an extensive overview of the disclosure. It is not intended to identify key or critical elements of the invention or to delineate the scope of the invention. The following summary merely presents some concepts of the disclosure in a simplified form as a prelude to the more detailed description provided below.

In one example, a lavalier microphone may include a mechanical enclosure or housing that carries the microphone's circuitry, including the microphone's diaphragm. Sound travels to the microphone's diaphragm through a sound passage that includes an opening in the mechanical enclosure. In this example, the lavalier microphone can be covered by an acoustical cap with at least two inlets and two corresponding cavities. The inlets and their corresponding cavities can form different Helmholtz resonators. When using the lavalier microphone, a user can orient the acoustical cap to align one of the two acoustic passages. Each Helmholtz resonator can be designed to allow the lavalier microphone to receive sounds with different frequency responses, which may allow a user to utilize the same lavalier microphone and with a single acoustical cap for better performance in a variety of different recording circumstances.

BRIEF DESCRIPTION OF THE DRAWINGS

A more complete understanding of the present disclosure and the advantages thereof may be acquired by referring to the following description in consideration of the accompanying drawings, in which like reference numbers indicate like features, and wherein.

DETAILED DESCRIPTION

In the following description of the various examples, reference is made to the accompanying drawings, which form a part hereof, and in which is shown by way of illustration various examples in which aspects may be practiced. References to "embodiment," "example," and the like indicate that the embodiment(s) or example(s) of the invention so described may include particular features, structures, or characteristics, but not every embodiment or example necessarily includes the particular features, structures, or characteristics. Further, it is contemplated that certain embodiments or examples may have some, all, or none of the features described for other examples. And it is to be understood that other embodiments and examples may be utilized and structural and functional modifications may be made without departing from the scope of the present disclosure.

Unless otherwise specified, the use of the serial adjectives, such as, "first," "second," "third," and the like that are used to describe components, are used only to indicate different components, which can be similar components. But the use of such serial adjectives are not intended to imply that the components must be provided in given order, either temporally, spatially, in ranking, or in any other way.

Also, while the terms "front," "back," "side," and the like may be used in this specification to describe various example features and elements, these terms are used herein as a matter of convenience, for example, based on the example orientations shown in the figures and/or the orientations in typical use. Nothing in this specification should be construed as requiring a specific three dimensional or spatial orientation of structures in order to fall within the scope of the claims.

Lavalier microphones may be used with an acoustical cap that covers the microphone and creates a resonant cavity. The microphone can be any number of different types, including MEMS, condenser, dynamic, ribbon, and optical.

The acoustical cap has inlets that allow sound to enter a resonant cavity. By adjust the sizes and shape of inlet and resonant cavity created by the acoustical cap, one can adjust the frequency response of sound that the microphone receives. For example, one can design the acoustical cap's inlet and respective resonant cavity to form a Helmholtz resonator. The classic Helmholtz resonator is a tube connected to a volume of air as shown in FIG. 9.

Figure 9:
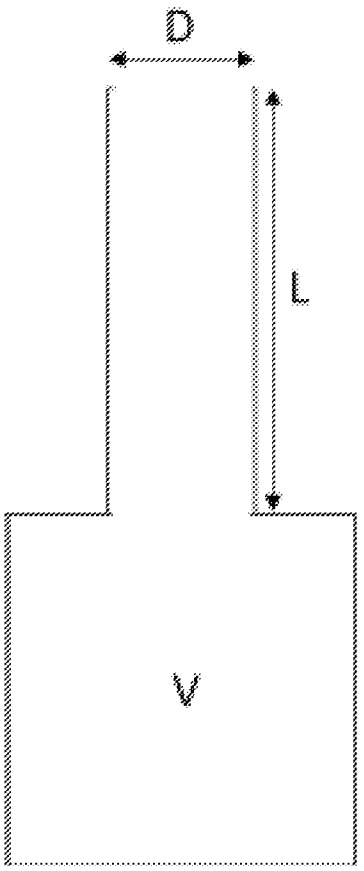
FIG. 9 is a diagram of a Helmholtz resonator.

FIG. 9, D is the tube diameter, and L is the tube length. V is the volume of air in the acoustical cavity in which the resonator terminates. Using these basic measurements, one can use the following equations as first order approximations to design the resonant cavity for specific performance characteristics:

$$M = \text{Acoustical Moving Mass} = \frac{\rho_0 L}{\pi r^2}\frac{kg}{m^3}$$

$$C_v = \text{Acoustical Compliance} = \frac{V}{\rho_0 c^2}\frac{m^5}{N}$$

$$R = \text{Acoustical Resistance} = \frac{\sqrt{2\omega\rho_0\mu}}{\pi r^2}\left(\frac{L}{r}+2\right)\frac{N*s}{m^5}$$

$$f_0 = \text{Resonant Frequency} = \frac{1}{2\pi\sqrt{MC_v}}\text{Hz}$$

$$Q = \text{Quality Factor} = \frac{1}{R}\sqrt{\frac{M}{C_v}}$$

$$\rho_0 = \text{Density of Air}$$

$$\mu = \text{Viscosity Coefficient of Air}$$

$$c = \text{Speed of Sound}$$

$$r = \text{Tube Radius}$$

$$V = \text{Cavity Volume}$$

$$\omega = \text{Angular Frequency}$$

The above equations represent a starting point for designing the shape of a resonant cavity between the acoustical cap and the microphone and would not be the sole predictor of performance.

Lavalier microphones may be wired or wireless. If wired, these microphones can be connected to a transmitter or receiver via any one of a variety of different cables, including a twisted wire pair, a coaxial cable, or fiber optics. These wired microphones can also connect to a transmitter or receiver using any one of a variety of different connectors, including a LEMO connector, an XLR connector, a TQG connector, a TRS connector, a USB, or RCA connectors. Lavalier microphones can also be wireless and connect an audio system through any one of a variety of protocols, including WiMAX, LTE, Bluetooth, Bluetooth Broadcast, GSM, 3G, 4G, 5G, Zigbee, 60 GHz Wi-Fi, Wi-Fi (e.g., compatible with IEEE 802.11a/b/g), or NFC protocols. In this embodiment, a transmitter can be included within or attached to the microphone.

Figure 1:
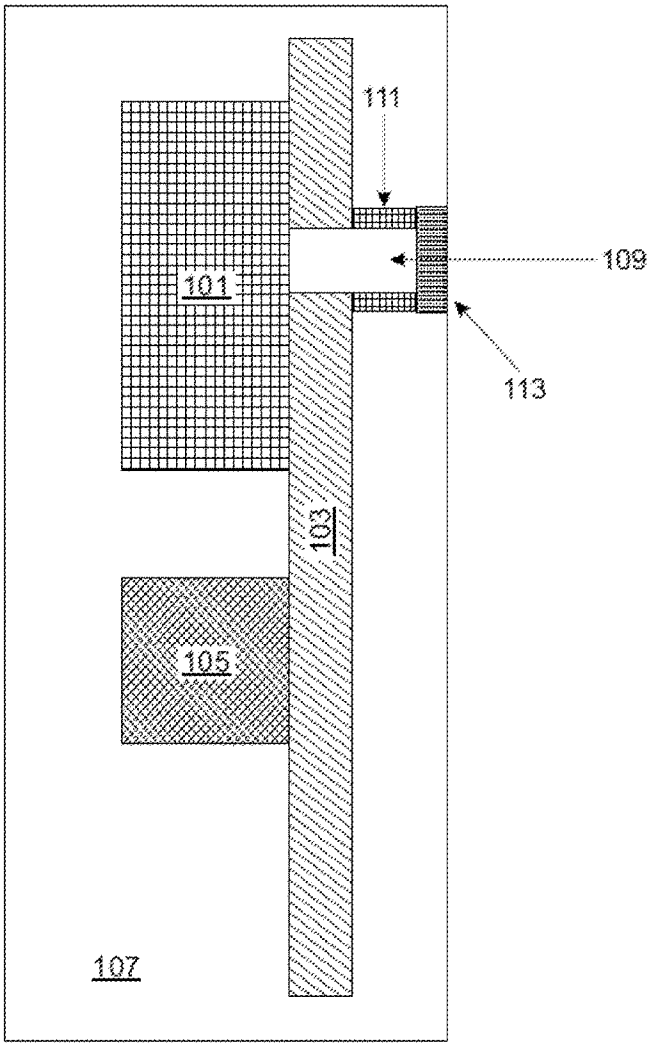
FIG. 1 is a schematic of an example lavalier microphone without an acoustical cap.

FIG. 1 is a schematic of an example lavalier microphone. A MEMS microphone die 101 is attached to substrate 103. Substrate 103 may be a printed circuit board (PCB). In this example, a MEMs microphone is used, but other types of microphones may be used. Further, the MEMs microphone die 101 may be attached to the substrate 103 with a die bonding material, such as an epoxy resin adhesive or silicone resin adhesive, so that no gap exists between the MEMs microphone die 101 and substrate 103.

An ASIC (Application Specific Integrated Circuit) chip 105 is also connected to substrate 103. The ASIC chip 105 is an integrated chip that amplifies the electrical output from MEMs microphone die 101. It can also be mounted to substrate 103 by a die-bonding material, such as an epoxy resin adhesive or silicone resin adhesive, so that no gap exists between the ASIC chip 105 and substrate 103. MEMs microphone die 101 and ASIC chip 105 can be connected electronically, such as by a wire, or can be incorporated into a single chip.

The described circuitry is surrounded in a mechanical enclosure 107, which in certain examples can be in the form of a housing. Although illustrated as solid, the mechanical enclosure 107 can also be a hollow shell that is metal, rigid plastic, or similar material. In this embodiment, the substrate 103 would by placed inside the mechanical enclosure 107 and secured, for example, by using a friction fit to snap into the mechanical enclosure 107, by an adhesive, by screws, or by some other similar means.

As illustrated in FIG. 1, sound reaches the MEMs microphone die 101 through sound passage 109, which is defined by a hole in the substrate 103, seal 111, and acoustical mesh 113. Seal 111 can be part of mechanical enclosure 107 or made of plastic, rubber, or other appropriate material to ensure that sound is confined to the sound passage 109. Acoustical mesh 113 can be made of cloth (e.g., nylon) or metal (e.g., stainless steel) and protects the MEMs microphone die 101 from dust and moisture.

The configuration of the circuitry in FIG. 1 is a back-port configuration, meaning that sound passage 109 includes a hole in substrate 103. However, in other example, the sound passage 109—and consequently, seal 111 and wire mesh 113—could be on the opposite side of the mechanical enclosure 107. This is a front-port configuration. The hole in substrate 103 would be unnecessary in this configuration. In yet another example, sound passage 109—and consequently, wire mesh 113—may be made in another side of the mechanical enclosure 107, which would require a bend in the passage, and consequently, seal 111. This is a side-port configuration. In a side-port configuration, sound passage 109 may or may not include a hole in the substrate 103 as in a back-port configuration.

Figure 2:
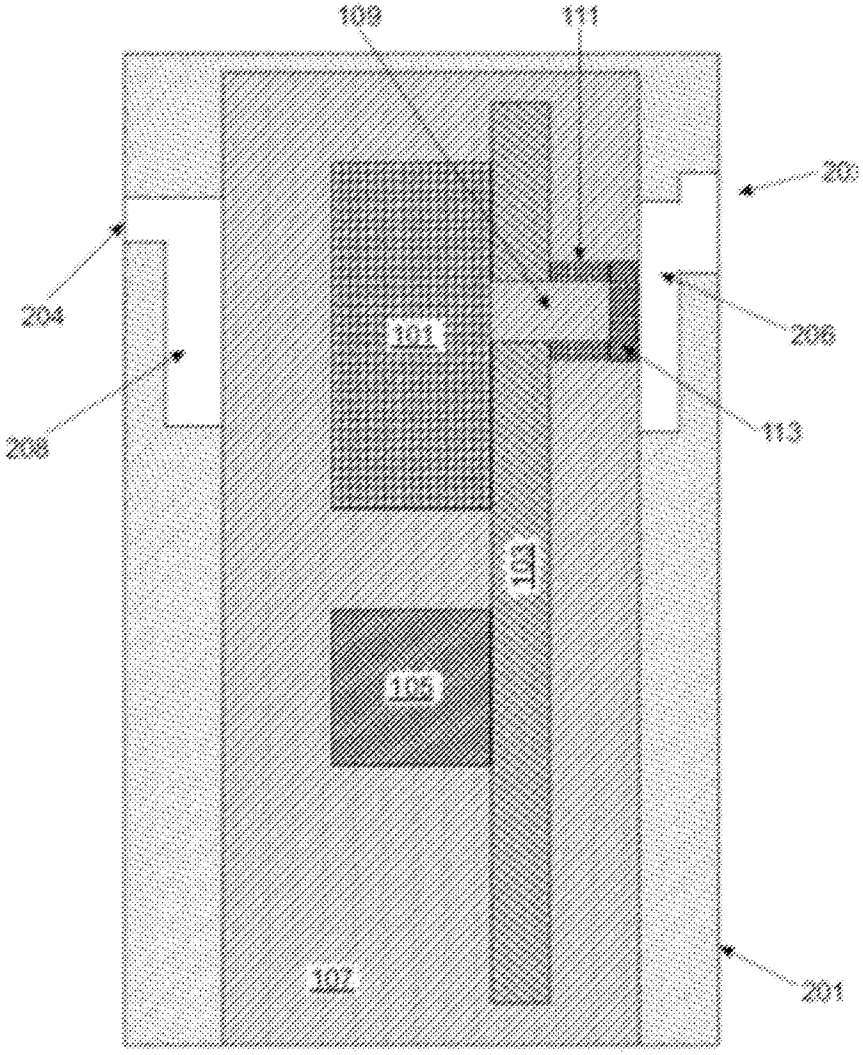
FIG. 2 is a schematic of the lavalier microphone of FIG. 1 that includes an acoustical cap in a first orientation relative to the lavalier microphone.

FIG. 2 is a schematic of the lavalier microphone of FIG. 1 that also includes acoustical cap 201 in a first orientation. Acoustical cap 201 has two sound inlets. For clarity, these will be referred to as presence boost inlet 202 and speech boost inlet 204. In this orientation, acoustical cap 201 is oriented to allow sound to enter through sound presence boost inlet 202, pass through the presence boost sound cavity 206, pass through the acoustical mesh 113, and pass through the sound passage 109 to reach the MEMs microphone die 101. While in this orientation, sound may enter the speech boost inlet 204 and speech boost cavity 208, but the sound will be inhibited from reaching the MEMs microphone die 101 because the mechanical enclosure 107 creates a barrier.

Figure 3:
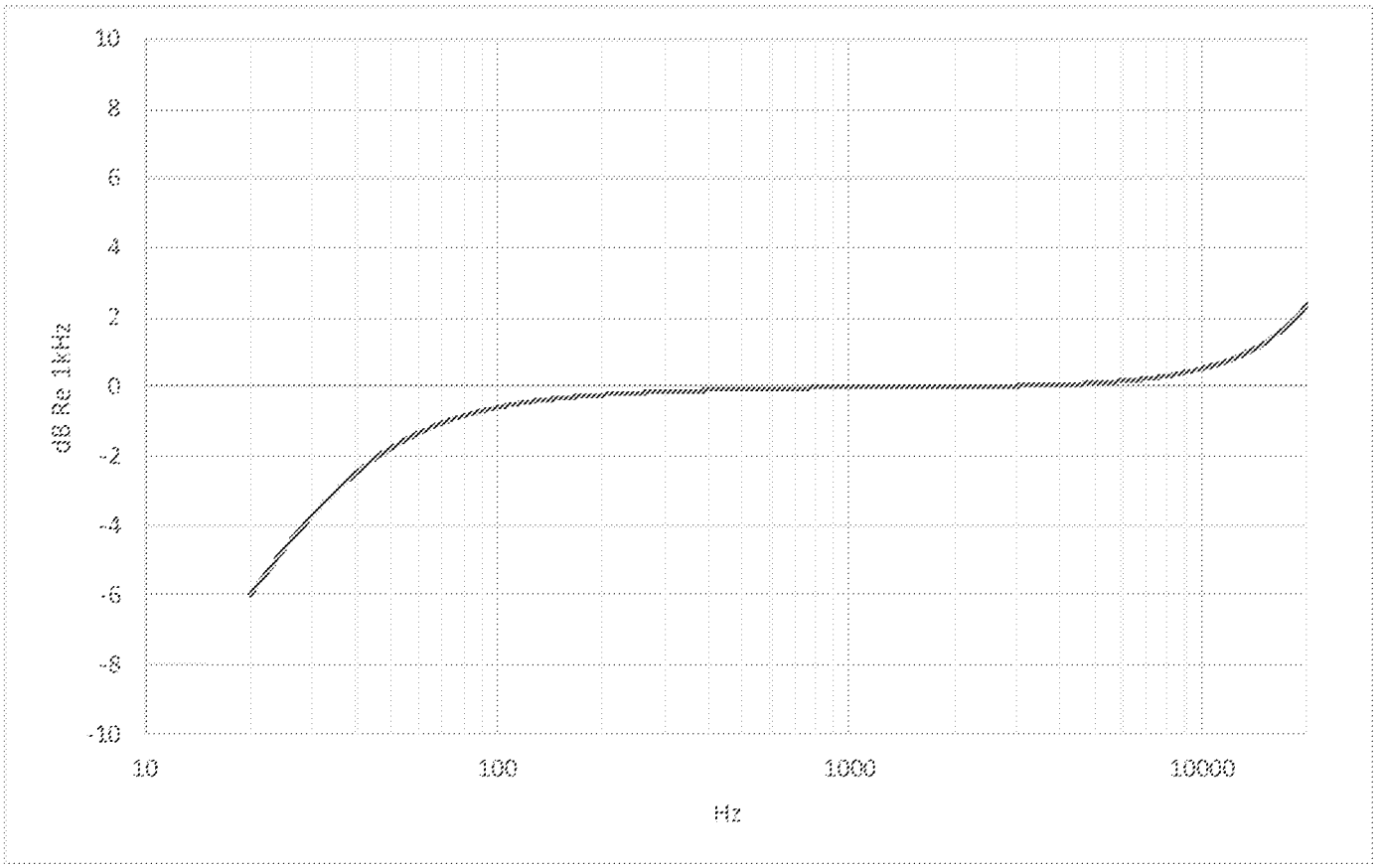
FIG. 3 is an example frequency response graph of the example lavalier microphone of FIG. 1 without an acoustical cap.
Figure 4:
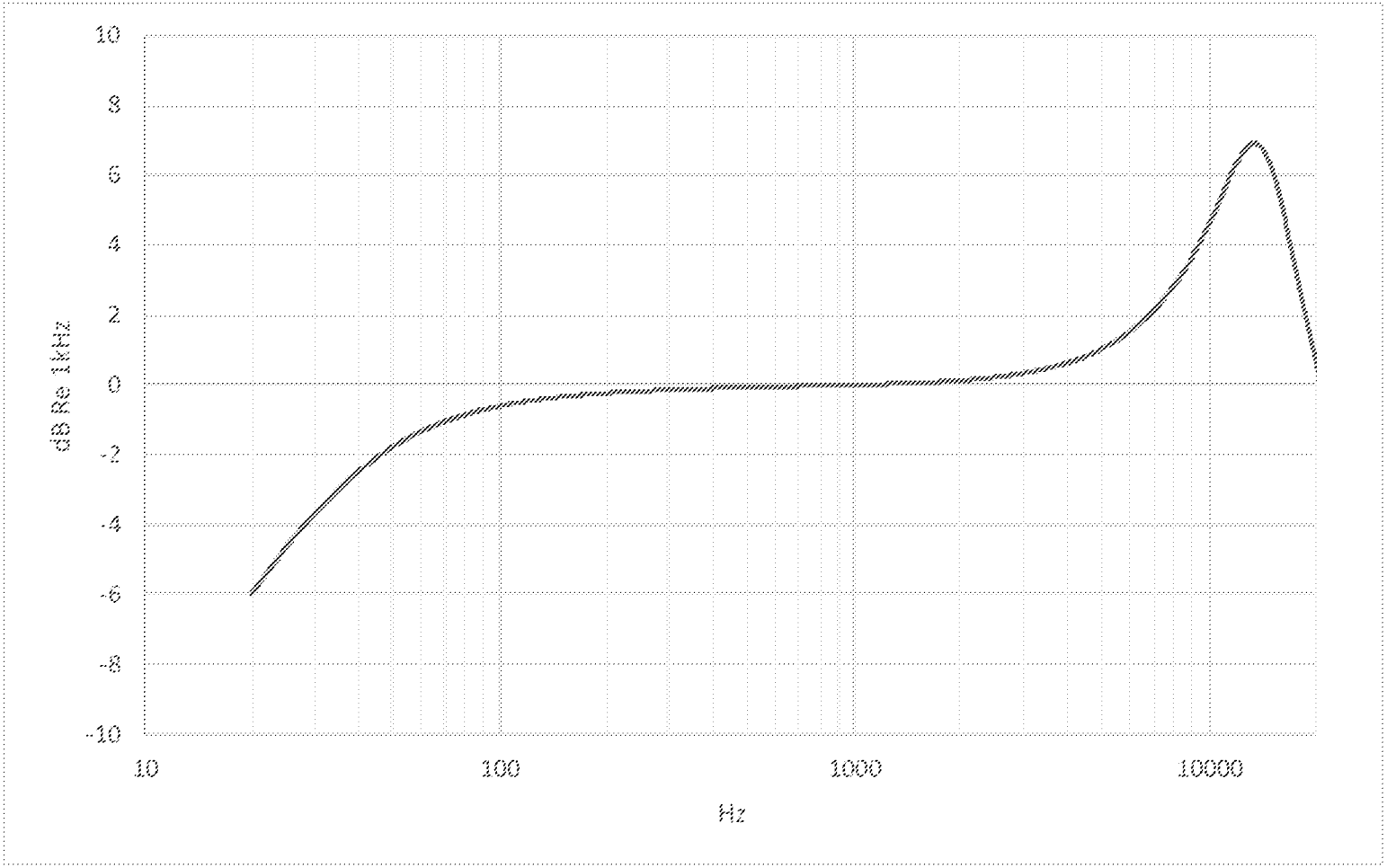
FIG. 4 is an example frequency response graph of the example lavalier microphone of FIG. 1 with the cap in the orientation of FIG. 2.

FIG. 3 is an example of a frequency response graph of a lavalier microphone without an acoustical cap. FIG. 4 is an example frequency response graph of the lavalier microphone when the acoustical cap 201 is in the first orientation as illustrated in FIG. 2. In the example of FIG. 4, the frequency response is balanced through a wide frequency range with a "boost" at approximately 10 kHz with a quality factor of approximately 5, which would be beneficial in musical performances when a microphone would be expected to amplify a wide range of frequencies and would also account for the space of the room of the performance.

Figure 5:
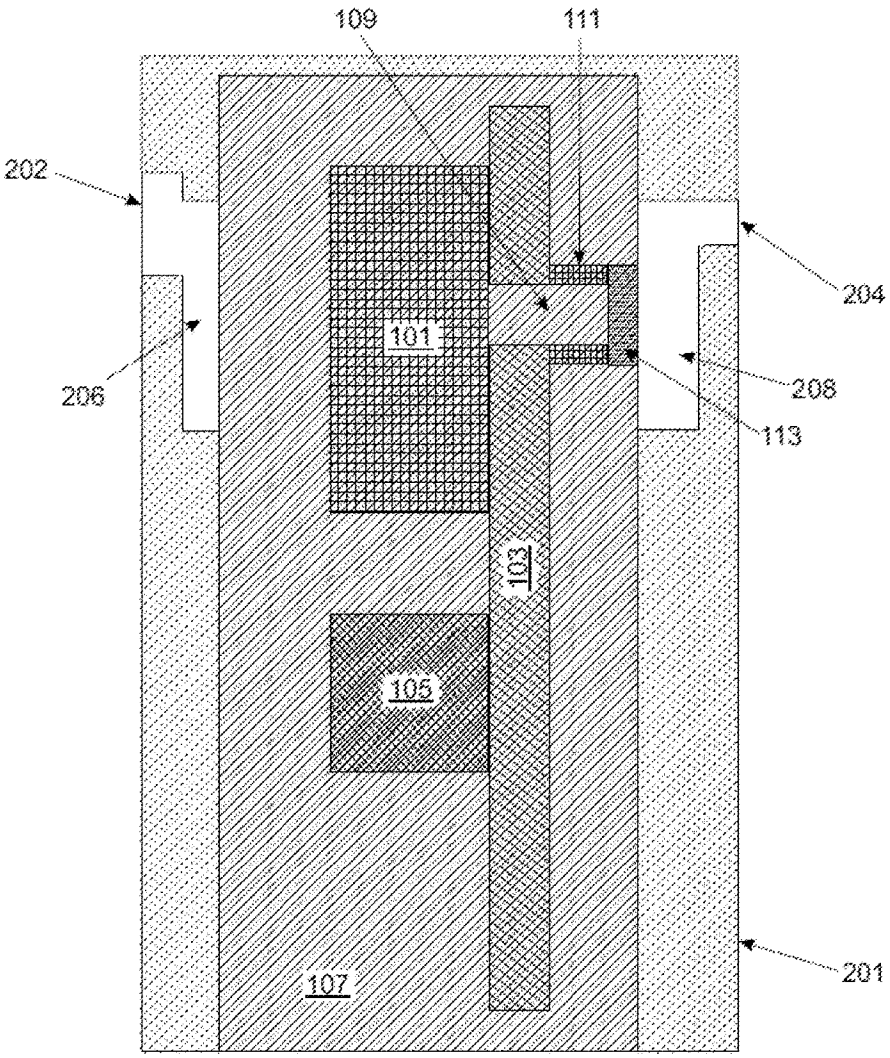
FIG. 5 is a schematic of the example lavalier microphone of FIG. 1 that includes the acoustical cap in a second orientation relative to the lavalier microphone.

FIG. 5 is a schematic of the lavalier microphone of FIG. 1 that includes an acoustical cap 201 in a second orientation that is rotated 180 degrees from the orientation in FIG. 2. In this orientation, acoustical cap 201 is oriented to allow sound to enter through speech boost inlet 204, pass through speech boost cavity 208, pass through the acoustical mesh 113, and pass through the sound passage 109 to reach the MEMs microphone die 101. While in this orientation, sound may still enter presence boost inlet 202 and sound presence boost cavity 206, but the sound will be inhibited from reaching the MEMs microphone die 101 because the mechanical enclosure 107 creates a barrier.

Figure 6:
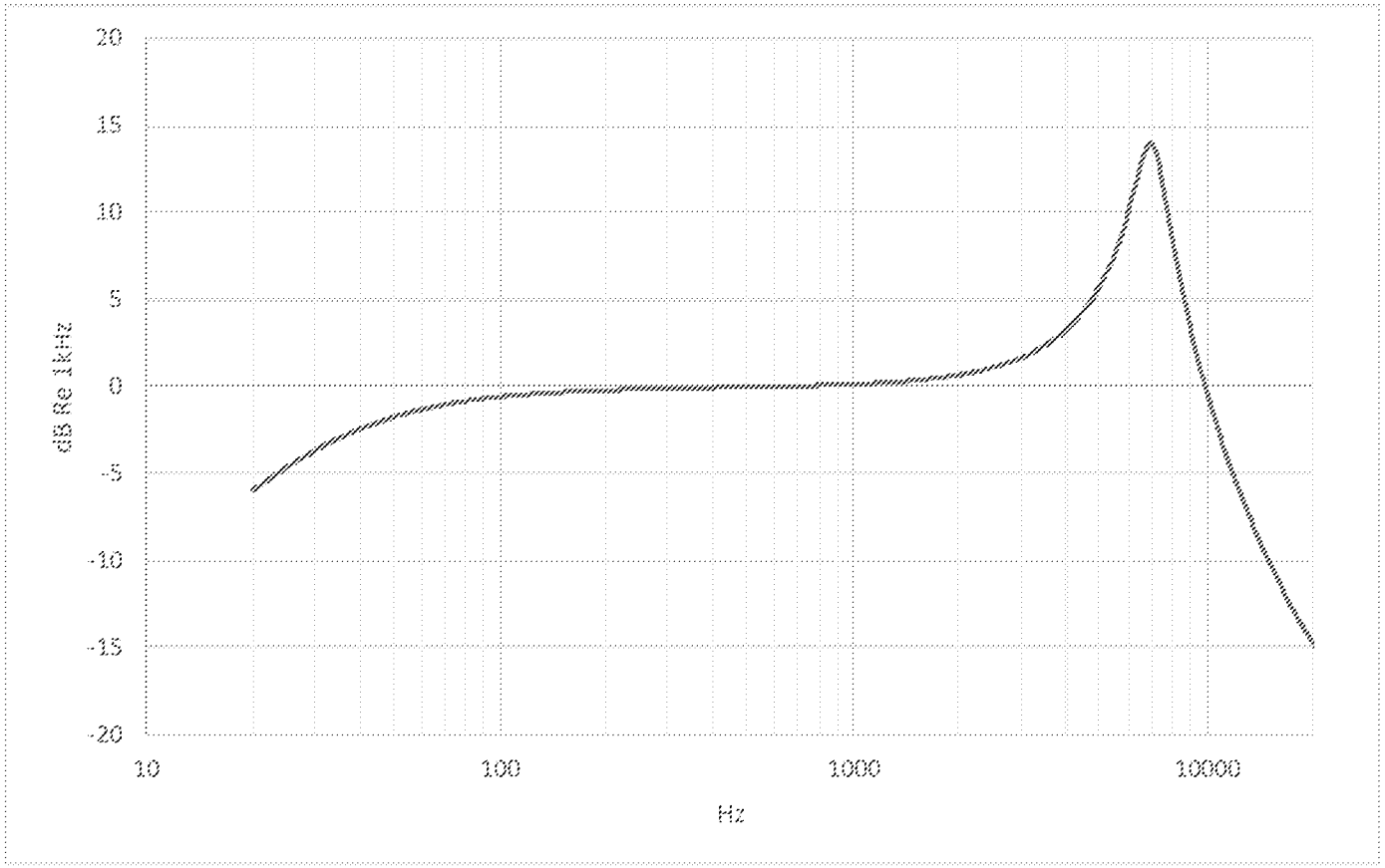
FIG. 6 is an example frequency response graph of an example lavalier microphone of FIG. 1 with the acoustical cap in the orientation of FIG. 5.

FIG. 6 is an example frequency response graph of the lavalier microphone when the acoustical cap 201 is in the second orientation as illustrated in FIG. 6. In this example, the frequency response includes a mid-frequency "boost" at approximately 6 kHz with a quality factor of approximately 8, which would emphasize speech. This frequency response would be helpful when the lavalier microphone is used in a film or news reporting situations and when the microphone is buried in clothing to hide the microphone from view.

Figure 7B:
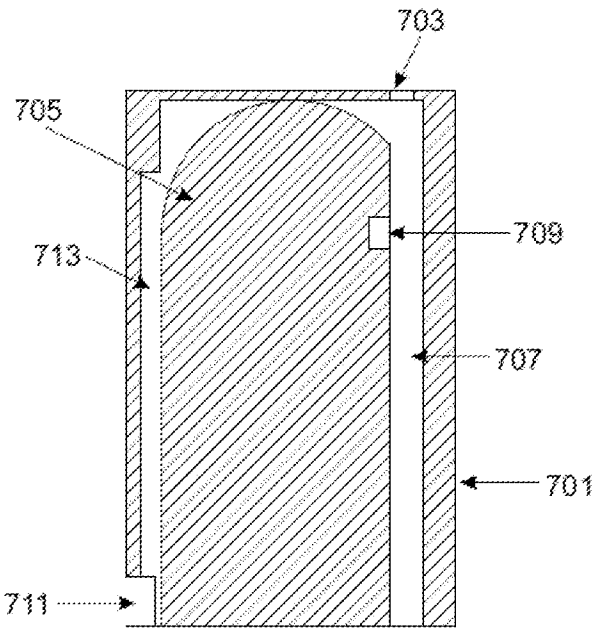
FIG. 7B is a cross-section of the lavalier microphone and acoustical cap in FIG. 7A.
Figure 7A:
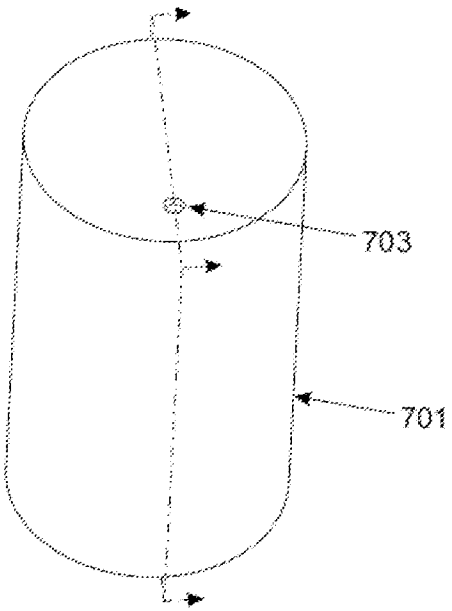
FIG. 7A is a perspective top view of a lavalier microphone with an acoustical cap in a first orientation relative to the lavalier microphone.
Figure 8B:
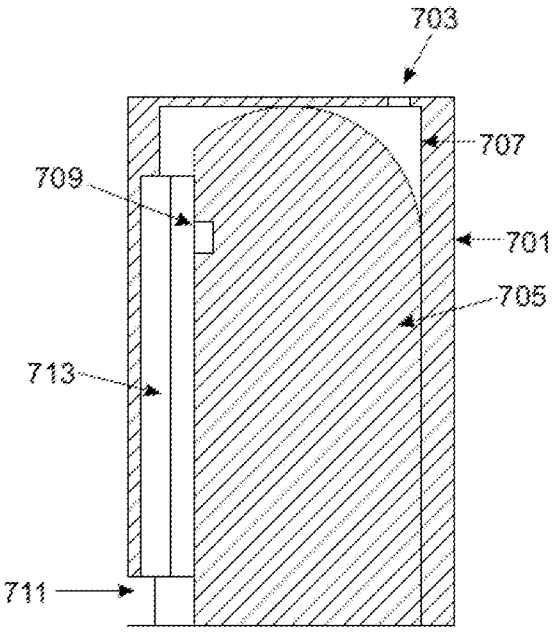
FIGS. 8A and 8B are a side view and a cross-section, respectively, of the lavalier microphone with the acoustical cap of FIG. 7A where the acoustical cap is in a second orientation relative to the lavalier microphone.
Figure 8A:
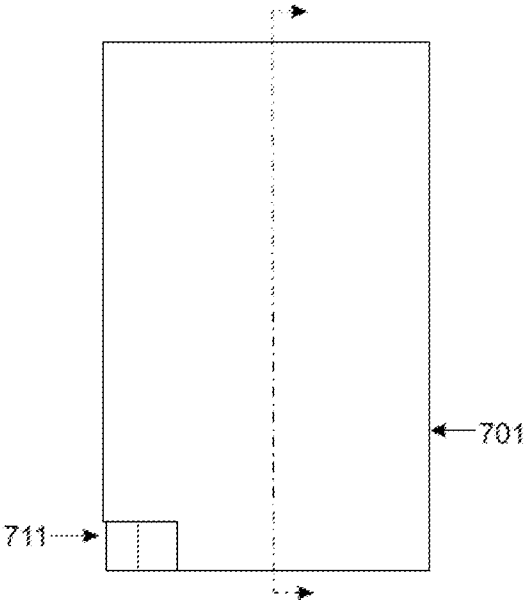

FIGS. 7A, 7B, 8A, and 8B are illustrations of a lavalier microphone with an acoustical cap. FIGS. 7A and 7B are illustrations of the lavalier microphone with the acoustical cap in a specific orientation, while FIGS. 8A and 8B are the same lavalier microphone with the same acoustical cap but rotated 180 degrees in relation to the lavalier microphone from the orientation of 7A and 7B.

Specifically, FIG. 7A is an illustration of a lavalier microphone with an acoustical cap 701 in a first orientation relative to the microphone. FIG. 7A shows an angled top perspective with an inlet 703 visible on the top of acoustical cap 701. Inlet 703 allows for sound to pass through to a resonant cavity between the acoustical cap 701 and the microphone. FIG. 7B is a cross section of this example, showing the acoustical cap 701 and mechanical enclosure 705 of the lavalier microphone. As stated, in this orientation, sound will pass through inlet 703 to sound cavity 707, which produces a specific frequency response based on the shape of inlet 703 and sound cavity 707. The sound would then enter the microphone through sound passage 709 in mechanical enclosure 705 for processing. FIG. 7B also shows a second inlet 711 for sound to enter into a second sound cavity 713. Although sound may enter inlet 711 into sound cavity 713, the sound is prevented from entering sound cavity 707, and thus sound passage 709, because it is blocked by mechanical enclosure 705's contact with acoustical cap 701, as illustrated.

FIG. 8A is an illustration of the lavalier microphone from FIGS. 7A and 7B but with acoustical cap 701 in a second orientation relative to the lavalier microphone. FIG. 8A shows a side view of acoustical cap 701 with inlet 711 visible. FIG. 8B is a cross section of this example showing acoustical cap 701 rotated 180 degrees in relation to mechanical enclosure 705. In this orientation, sound will pass through inlet 711 to sound cavity 713, which produces a specific sound frequency response based on the shape of inlet 711 and sound cavity 713 that is different from the frequency response produced by sound inlet 703 and sound cavity 707. Sound would then enter the microphone as before through sound passage 709 of mechanical enclosure 705 for processing. Sound may still enter inlet 703 and sound cavity 707, but the sound is prevented from entering sound cavity 713, and thus sound passage 709, because it is again blocked by mechanical enclosure 705's contact with acoustical cap 701 as illustrated.

The inlet and sound cavity combinations of the above embodiments are just examples of possible resonators, and it is understood that various sizes and shapes of both inlets and cavities may be used. Thus, one can use this technology in a variety of settings (e.g., theater, small venue, concert hall, auditorium) and for a variety of purposes (e.g., miking instruments or voices, miking for a musical performance or public speaking event) by creating various frequency responses for the microphone.

In the example illustrated in FIGS. 7 and 8, both the acoustical cap 701 and mechanical enclosure 705 are depicted as cylinders, but both could also be a variety of shapes (e.g., cubes, rectangular prisms, spheres). Further, the acoustical cap can have more than two inlets and corresponding cavities. For example, a cylindrical acoustical cap could include a four different inlets and corresponding cavities separated by 90 degrees around the cylinder. The placement of the inlets and corresponding cavities on the acoustical cap can be based on the size and shape of the both the mechanical enclosure and acoustical cap and the location of the sound passage (e.g., whether it is in a front, back, or side port configuration).

In the example of FIGS. 7-8, acoustical cap 701 is attached to mechanical enclosure 705 by sliding the acoustical cap 701 over the mechanical enclosure 705. Although not pictured, the acoustical cap 701 could be secured to the mechanical enclosure 705 in a variety of methods, including a snap-fit type connection (e.g., projections on mechanical enclosure 705 that engage with cutouts on acoustical cap 701), latches, buttons, or straps. These type of connections would allow a user to completely remove acoustical cap 701 from the mechanical enclosure 705, such as when a user is removing acoustical cap 701 to turn the cap to utilize another sound inlet and corresponding cavity or when a user is substituting the cap for another.

Alternatively, an acoustical cap could be fixed to the mechanical enclosure. In this example, the acoustical cap would be attached in a way that it could swivel or rotate around the mechanical enclosure (e.g., by a screw or pin) so a user would alternate between various inlets and cavities by swiveling or rotating the acoustical cap around the mechanical enclosure.

In another example, a microphone unit comprises a microphone assembly, a mechanical enclosure that houses the microphone assembly. The mechanical enclosure comprises an outer surface, a sound inlet on the outer surface, and a sound passage that allows sound to travel from the sound inlet to a microphone. The mechanical enclosure may further include a seal that surrounds the sound pathway. The microphone unit also comprises an acoustical cap with an outer surface and an inner surface defining a cavity within which the mechanical enclosure may be coupled. The acoustical cap comprises at least two acoustical inlets in the outer surface and at least two resonant cavities that have openings on the inner surface in the acoustical cap, wherein at least a first acoustical inlet of the at least two acoustical inlets connects to a first resonant cavity of the at least two resonant cavities, and at least a second acoustical inlet of the at least two acoustical inlets connects to a second resonant cavity of the at least two resonant cavities. The first acoustical inlet differs in dimensions than the second acoustical inlet. Further, the first resonant cavity differs in dimensions than the second resonant cavity. The two different resonator cavities cause at least two different frequency responses. For instance, one frequency response could emphasize frequencies associated with a human voice or to emphasize a specific frequency such as 10 kHz. The acoustical cap is removably coupled to the mechanical enclosure. The microphone assembly may further comprise a transmitter to allow the microphone unit to wirelessly connect to a receiver.

The above examples provide acoustical caps having more than one acoustical response. In certain examples having separate acoustical caps for different recording situations may require a user to carry multiple acoustical caps. If a user only has a single acoustical cap, that acoustical cap may not allow the user to adjust on the fly the frequency response of the sound that the microphone receives. Further, having acoustical caps with only a single frequency resonator may require manufacturers to produce and sell many different acoustical caps for the various circumstances one would utilize these type of microphones. This may add inefficiencies in the manufacturing process and supply chain.

Finally, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A microphone unit comprising:

a microphone assembly;

a mechanical enclosure that houses the microphone assembly, wherein the mechanical enclosure comprises:

an outer surface, a sound inlet on the outer surface, and a sound passage that allows sound to travel from the sound inlet to the microphone assembly; and an acoustical cap comprising an outer surface and an inner surface defining a cavity within which the mechanical enclosure may be coupled, wherein the acoustical cap further comprises:

at least two acoustical inlets in the outer surface and at least two resonant cavities that have openings on the inner surface in the acoustical cap, wherein at least a first acoustical inlet of the at least two acoustical inlets connects to a first resonant cavity of the at least two resonant cavities, and at least a second acoustical inlet of the at least two acoustical inlets connects to a second resonant cavity of the at least two resonant cavities, wherein the at least two resonant cavities cause at least two different frequency responses.

2. The microphone unit of claim 1, wherein the first acoustical inlet differs in dimensions than the second acoustical inlet.

3. The microphone unit of claim 2, wherein the first resonant cavity differs in dimensions than the second resonant cavity.

4. The microphone unit of claim 1, wherein the mechanical enclosure further includes a seal that surrounds the sound passage.

5. The microphone unit of claim 1, wherein the sound passage includes a hole in a substrate.

6. The microphone unit of claim 1, wherein the acoustical cap is removably coupled to the mechanical enclosure.

7. The microphone unit of claim 1, wherein the microphone assembly further comprises a transmitter to allow the microphone unit to wirelessly connect to a receiver.

8. A method comprising:

configuring a mechanical enclosure to house a microphone assembly, wherein the mechanical enclosure comprises an outer surface, a sound inlet on the outer surface, and a sound passage that allows sound to travel from the sound inlet to the microphone assembly; and configuring an acoustical cap to couple with the mechanical enclosure, wherein the acoustical cap comprises an outer surface, an inner surface, and a cavity for the mechanical enclosure to couple, wherein the acoustical cap is further configured to include at least two acoustical inlets in the outer surface connected to at least two respective resonant cavities that have openings on the inner surface in the acoustical cap, wherein the at least two acoustical inlets and the at least two respective resonant cavities form at least two different resonators, wherein the at least two different resonators cause at least two different frequency responses.

9. The method of claim 8 wherein the at least one of the frequency responses corresponds to emphasizing frequencies associated with a human voice.

10. The method of claim 8 wherein the at least one of the frequency responses corresponds to emphasizing a 10 kHz frequency.

11. The method of claim 8, wherein the acoustical cap is oriented so that a first resonator is aligned with the sound inlet.

12. The method of claim 11, wherein the coupling of the acoustical cap to the mechanical enclosure is adjustable so that a user may adjust the orientation of the acoustical cap to the mechanical enclosure so that a second resonator is aligned with the sound inlet instead of the first resonator.

13. The method of claim 8, wherein the acoustical cap is configured to be removably coupled to the mechanical enclosure.

14. An acoustical cap for a microphone comprising:

an outer surface;

an inner surface defining a cavity within which a microphone may be coupled;

at least two acoustical inlets in the outer surface; and at least two resonant cavities that have openings on the inner surface, wherein:

at least a first acoustical inlet connects to a first resonant cavity to form a first resonator, and at least a second acoustical inlet connects to a second resonant cavity to form a second resonator, wherein the first resonator causes a different frequency response than the frequency response caused by the second resonator.

15. The acoustical cap of claim 14, wherein the frequency response caused by the first resonator corresponds to emphasizing frequencies associated with a human voice.

16. The acoustical cap of claim 14, wherein the frequency response of the second resonator corresponds to emphasizing a 10 kHz frequency.

17. The acoustical cap of claim 14, wherein the inner surface is configured to be removably coupled to a microphone.

18. The acoustical cap of claim 14, wherein the inner surface is configured to be coupled to a microphone so that it can rotate around the microphone without the acoustical cap being removed.

* * * * *